US008982000B2

(12) United States Patent
Kim et al.

(10) Patent No.: US 8,982,000 B2
(45) Date of Patent: Mar. 17, 2015

(54) WATCH TYPE MOBILE TERMINAL AND ANTENNA THEREOF

(75) Inventors: Changil Kim, Gyeonggi-Do (KR); Jaehyuk Kang, Gyeonggi-Do (KR); Kyunghack Yi, Seoul (KR); Jonghun Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 310 days.

(21) Appl. No.: 12/832,916

(22) Filed: Jul. 8, 2010

(65) Prior Publication Data

US 2011/0012796 A1 Jan. 20, 2011

(30) Foreign Application Priority Data

Jul. 15, 2009 (KR) ..... 10-2009-0064669

(51) Int. Cl.
*H01Q 1/24* (2006.01)
*H01Q 1/27* (2006.01)

(52) U.S. Cl.
CPC ..... *H01Q 1/273* (2013.01)
USPC ..... 343/702; 343/718; 343/895

(58) Field of Classification Search
CPC ..... H01Q 1/273
USPC ..... 343/718, 895; 455/39; 700/94; 368/10; 345/168
See application file for complete search history.

(56) References Cited

U.S. PATENT DOCUMENTS

| | | | | |
|---|---|---|---|---|
| 3,935,700 | A * | 2/1976 | Van Haaften | 368/29 |
| 3,983,350 | A * | 9/1976 | Camin | 200/61.47 |
| 4,847,818 | A * | 7/1989 | Olsen | 368/10 |
| 5,627,552 | A | 5/1997 | Farrar et al. | |
| 5,699,319 | A * | 12/1997 | Skrivervik | 368/10 |
| 6,366,250 | B1 * | 4/2002 | McConnell | 343/718 |
| 6,950,685 | B2 * | 9/2005 | Barras et al. | 455/575.1 |
| 6,992,952 | B2 * | 1/2006 | Endo et al. | 368/10 |
| 2002/0093489 | A1 * | 7/2002 | Kaikuranta et al. | 345/169 |
| 2002/0135536 | A1 * | 9/2002 | Bruning | 345/1.1 |
| 2006/0220957 | A1 | 10/2006 | Tanaka et al. | |
| 2009/0295731 | A1 * | 12/2009 | Kim et al. | 345/168 |

FOREIGN PATENT DOCUMENTS

KR 10 2008 0050460 * 3/2009 ..... H01Q 1/24

* cited by examiner

*Primary Examiner* — Sue A Purvis
*Assistant Examiner* — Jae Kim
(74) *Attorney, Agent, or Firm* — Lee, Hong, Degerman, Kang & Waimey

(57) ABSTRACT

A watch type mobile terminal includes a first case which includes a window; a second case coupled to the first case and having an area for mounting a plurality of components; and a third case coupled to the second case such that the plurality of components are positioned between the second case and the third case. The mobile terminal further includes an antenna positioned at a side portion of a case including the first case, the second case, and the third case. The antenna includes a first conductor which is attached to the plurality of components, substantially covered by the second case, and connected to a signal feeding portion; and a second conductor which is positioned to be separated from the first conductor such that the second conductor is electrically coupled with the first conductor and connected to a ground feeding unit to be connected to a ground.

18 Claims, 8 Drawing Sheets

WATCH TYPE MOBILE TERMINAL AND ANTENNA THEREOF

CROSS REFERENCE TO RELATED APPLICATIONS

Pursuant to 35 U.S.C. §119, this application claims the benefit of Korean Application No. 10-2009-0064669, filed on Jul. 15, 2009, the contents of which is hereby incorporated by reference herein in its entirety.

BACKGROUND OF THE INVENTION

1. Field of the Invention

The present invention relates to a watch type mobile terminal that can be put on a human body such as a user's wrist, arm, and so on.

2. Description of the Related Art

A watch type mobile terminal is a device that can be carried around and has one or more functions such as voice and video call communication, inputting and outputting information, storing data, and the like.

As such functions become more diversified, the watch type mobile terminal can support more complicated functions such as capturing images or video, reproducing music or video files, playing games, receiving broadcast signals, and the like. By comprehensively and collectively implementing such functions, the watch type mobile terminal may be embodied in the form of a multimedia player or device.

In order to implement various functions of such multimedia players or devices, the multimedia player requires sufficient support in terms of hardware or software, for which numerous attempts are being made and implemented. For example, a user interface allowing users to easily and conveniently search for and select one or more functions is provided.

Also, as watch type mobile terminals are considered a personal mobile object that can express users' personality, various designs are required. Such demand on designs may include a structural alteration and modification allowing users to conveniently use watch type mobile terminal, and as one of such structural alteration and modification, a watch-type watch type mobile terminal that can be put on the user's wrist to use can be considered. Because a watch type mobile terminal serves as a clock as well as a watch type mobile terminal, a reduction in thickness and size and simplified design are critical for designing a watch-type watch type mobile terminal.

SUMMARY OF THE INVENTION

Accordingly, one object of the present invention is to address the above-noted and other problems.

Another object of the present invention is to provide a watch type mobile terminal that can be put on the user's wrist and includes an antenna disposed within a case having a great mechanical restriction, thus improving an external appearance and accomplishing good radio performance.

To achieve these and other advantages and in accordance with the purpose of the present invention, as embodied and broadly described herein, the present invention provides in one aspect a watch type mobile terminal including: a case whose both ends are connected by a band and an antenna installed in the case, wherein the antenna includes: a first conductor disposed at an inner side of the case and formed such that the first conductor can be connected to a signal feeding portion; and a second conductor disposed to be separated from the first conductor such that the second conductor is electrically coupled with the first conductor and formed such that the second conductor can be connected to a ground feeding unit.

The case may include: a first conductive case forming a surrounding configuration of a window; a second dielectric case assembled to a lower portion of the first case and having an accommodation space part for accommodating a component therein; and a third conductive case assembled to a lower portion of the second case and forming a ground.

The second case may include a slope side, and the antenna may be disposed on an inner surface of the slope side.

The antenna may be formed to have a plate form attached to a dielectric carrier.

The first conductor may include a first end portion formed to be convex, and the second conductor may include a second end portion disposed to be separated from the first end portion with a certain gap therebetween and formed to be protruded.

The first case may be formed to be inserted in the second case.

The watch type mobile terminal may further include: a first ground extending part extending a ground at an inner side of the second case to the first case.

The ground extending part may include a conductive layer disposed to be adjacent to the first case at a certain interval at an inner side of the second case.

The first ground extending part may be disposed on the opposite side of the side of the second case where the antenna is disposed.

A touch pad may be formed at an inner side of an upper end of the first case to detect a touch, and a controller of the touch pad may be disposed to be adjacent to the side of the second case where the first ground extending part is disposed.

The first ground extending part may be directly connected to the third case by a flexible printed circuit board (FPCB).

The watch type mobile terminal may further include: a second ground extending part extending a ground to the band.

The second ground part may be implemented in the form of a flexible conductive tape inserted to be parallel to the band.

The band may include: a support member supporting a pin; and a connection member disposed at the inner side of the support member and connected to the second ground extending part.

The connection member may include a protrusion such that the protrusion can be brought into contact with the third case when the band is assembled, and the third case may include an accommodation recess accommodating the protrusion therein.

To achieve these and other advantages and in accordance with the purpose of the present invention, as embodied and broadly described herein, the present invention provides in another aspect a watch type mobile terminal including: a first conductive case forming a surrounding configuration of a window; a second dielectric case assembled to a lower portion of the first case and having an accommodation space part for accommodating a component therein; a third conductive case assembled to a lower portion of the second case and forming a ground; an antenna installed at an inner side of the second case; and a ground extending part extending a ground of the antenna to the first case.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

A watch type mobile terminal according to exemplary embodiments of the present invention will now be described in detail. In the following description, usage of suffixes such as 'module', 'part' or 'unit' used for referring to elements is given merely to facilitate explanation of the present invention, without having any significant meaning by itself.

The watch type mobile terminal described in the present invention may include mobile phones, smart phones, notebook computers, digital broadcast receivers, PDAs (Personal Digital Assistants), PMPs (Portable Multimedia Player), navigation devices, and the like.

Figure 1:
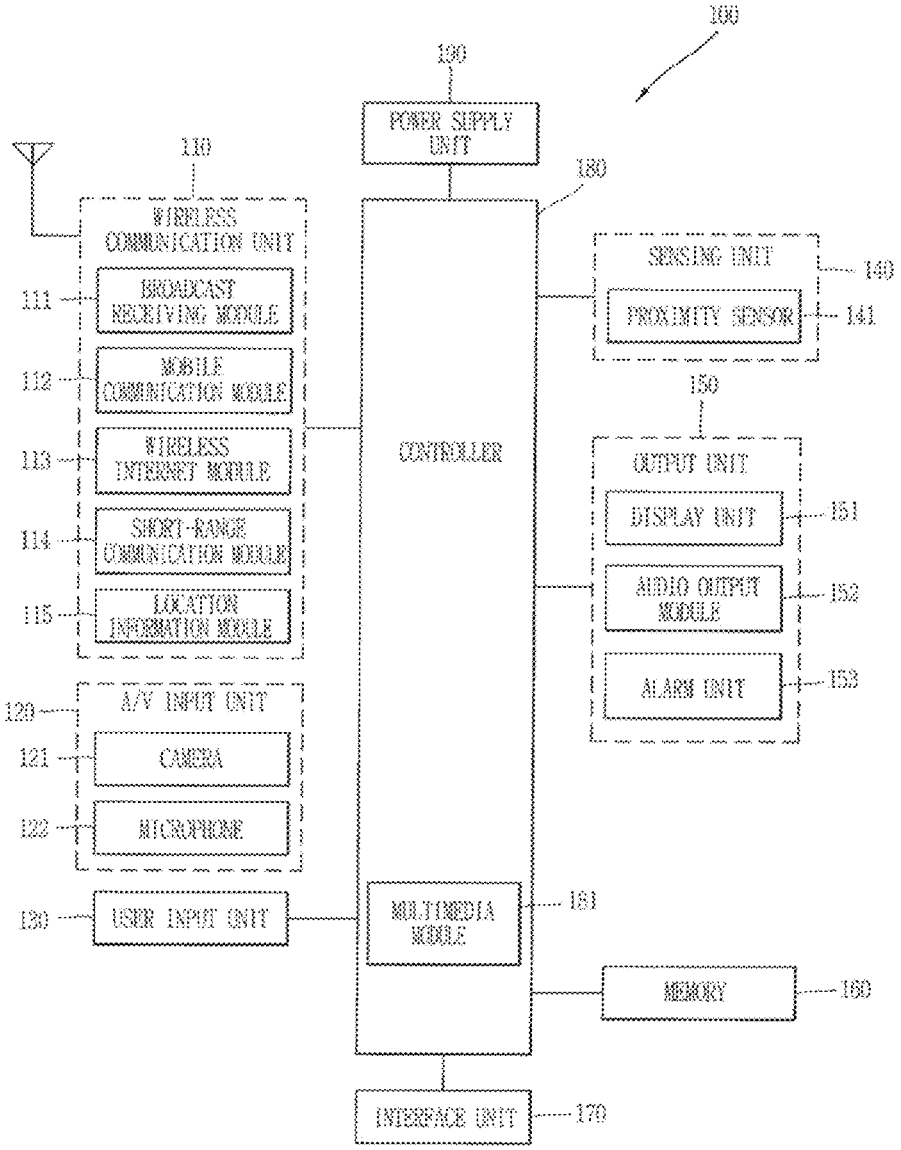
FIG. 1 is a schematic block diagram of a watch type mobile terminal according to an exemplary embodiment of the present invention.

FIG. 1 is a block diagram of a watch type mobile terminal according to an embodiment of the present invention.

The watch type mobile terminal 100 may include a wireless communication unit 110, an A/V (Audio/Video) input unit 120, a user input unit 130, a sensing unit 140, an output unit 150, a memory 160, an interface unit 170, a controller 180, and a power supply unit 190, etc. FIG. 1 shows the watch type mobile terminal as having various components, but it should be understood that implementing all of the illustrated components is not a requirement. Greater or fewer components may alternatively be implemented.

The elements of the watch type mobile terminal will be described in detail as follows.

The wireless communication unit 110 typically includes one or more components allowing radio communication between the watch type mobile terminal 100 and a wireless communication system or a network in which the watch type mobile terminal is located. For example, the wireless communication unit may include at least one of a broadcast receiving module 111, a mobile communication module 112, a wireless Internet module 113, a short-range communication module 114, and a location information module 115.

The broadcast receiving module 111 receives broadcast signals and/or broadcast associated information from an external broadcast management server (or other network entity) via a broadcast channel. The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal. The broadcast signal may include a TV broadcast signal, a radio broadcast signal, a data broadcast signal, and the like. Also, the broadcast signal may further include a broadcast signal combined with a TV or radio broadcast signal. The broadcast associated information may refer to information associated with a broadcast channel, a broadcast program or a broadcast service provider. The broadcast associated information may also be provided via a mobile communication network and, in this case, the broadcast associated information may be received by the mobile communication module 112.

The broadcast signal may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may be configured to receive signals broadcast by using various types of broadcast systems. In particular, the broadcast receiving module 111 may receive a digital broadcast by using a digital broadcast system such as multimedia broadcasting-terrestrial (DMB-T), digital multimedia broadcasting-satellite (DMB-S), digital video broadcast-handheld (DVB-H), the data broadcasting system known as media forward link only (MediaFLO®), integrated services digital broadcast-terrestrial (ISDB-T), etc. The broadcast receiving module 111 may be configured to be suitable for every broadcast system that provides a broadcast signal as well as the above-mentioned digital broadcast systems.

Broadcast signals and/or broadcast-associated information received via the broadcast receiving module 111 may be stored in the memory 160 (or anther type of storage medium).

The mobile communication module 112 transmits and/or receives radio signals to and/or from at least one of a base station (e.g., access point, Node B, etc.), an external terminal (e.g., other user devices) and a server (or other network entities). Such radio signals may include a voice call signal, a video call signal or various types of data according to text and/or multimedia message transmission and/or reception.

The wireless Internet module 113 supports wireless Internet access for the watch type mobile terminal. This module may be internally or externally coupled to the terminal. The wireless Internet access technique implemented may include a WLAN (Wireless LAN) (Wi-Fi), Wibro (Wireless broadband), Wimax (World Interoperability for Microwave Access), HSDPA (High Speed Downlink Packet Access), or the like.

The short-range communication module 114 is a module for supporting short range communications. Some examples of short-range communication technology include Bluetooth™, Radio Frequency IDentification (RFID), Infrared Data Association (IrDA), Ultra-WideBand (UWB), ZigBee™, and the like.

The location information module 115 is a module for checking or acquiring a location (or position) of the watch type mobile terminal. A typical example of the location information module is a GPS (Global Positioning System). According to the current technology, the GPS module 115 calculates distance information from three or more satellites and accurate time information and applies trigonometry to the calculated information to thereby accurately calculate three-dimensional current location information according to latitude, longitude, and altitude. Currently, a method for calculating location and time information by using three satellites and correcting an error of the calculated location and time information by using another one satellite has been provided. In addition, the GPS module 115 can calculate speed information by continuously calculating the current location in real time.

The A/V input unit 120 is configured to receive an audio or video signal. The A/V input unit 120 may include a camera 121 (or other image capture device) and a microphone 122 (or other sound pick-up device). The camera 121 processes image data of still pictures or video obtained by an image capture device in a video capturing mode or an image capturing mode. The processed image frames may be displayed on a display unit 151 (or other visual output device).

The image frames processed by the camera 121 may be stored in the memory 160 (or other storage medium) or transmitted via the wireless communication unit 110. Two or more cameras 121 may be provided according to the configuration of the watch type mobile terminal.

The microphone 122 may receive sounds (audible data) via a microphone (or the like) in a phone call mode, a recording mode, a voice recognition mode, and the like, and can process such sounds into audio data. The processed audio (voice) data may be converted for output into a format transmittable to a mobile communication base station (or other network entity) via the mobile communication module 112 in case of the phone call mode. The microphone 122 may implement various types of noise canceling (or suppression) algorithms to cancel (or suppress) noise or interference generated in the course of receiving and transmitting audio signals.

The user input unit 130 (or other user input device) may generate input data from commands entered by a user to control various operations of the watch type mobile terminal. The user input unit 130 may include a keypad, a dome switch, a touch pad (e.g., a touch sensitive member that detects changes in resistance, pressure, capacitance, etc. due to being contacted) a jog wheel, a jog switch, and the like.

The sensing unit 140 (or other detection means) detects a current status (or state) of the watch type mobile terminal 100 such as an opened or closed state of the watch type mobile terminal 100, a location of the watch type mobile terminal 100, the presence or absence of user contact with the watch type mobile terminal 100 (i.e., touch inputs), the orientation of the watch type mobile terminal 100, an acceleration or deceleration movement and direction of the watch type mobile terminal 100, etc., and generates commands or signals for controlling the operation of the watch type mobile terminal 100. For example, when the watch type mobile terminal 100 is implemented as a slide type mobile phone, the sensing unit 140 may sense whether the slide phone is opened or closed. In addition, the sensing unit 140 can detect whether or not the power supply unit 190 supplies power or whether or not the interface unit 170 is coupled with an external device. The sensing unit 140 may include a proximity sensor 141. The proximity sensor 141 will be described in relation to a touch screen later.

The interface unit 170 serves as an interface by which at least one external device may be connected with the watch type mobile terminal 100. For example, the external devices may include wired or wireless headset ports, an external power supply ports, wired or wireless data ports, memory card ports, ports for connecting a device having an identification module, audio input/output (I/O) ports, video I/O ports, earphone ports, or the like.

The identification module may be a chip that stores various information for authenticating user's authority for using the watch type mobile terminal 100 and may include a user identity module (UIM), a subscriber identity module (SIM) a universal subscriber identity module (USIM), and the like. In addition, the device having the identification module (referred to as the 'identifying device', hereinafter) may take the form of a smart card. Accordingly, the identifying device may be connected with the terminal 100 via a port or other connection means. The interface unit 170 may be used to receive inputs (e.g., data, information, power, etc.) from an external device and transfer the received inputs to one or more elements within the watch type mobile terminal 100 or may be used to transfer data between the watch type mobile terminal and an external device.

In addition, when the watch type mobile terminal 100 is connected with an external cradle, the interface unit 170 may serve as a conduit to allow power from the cradle to be supplied therethrough to the watch type mobile terminal 100 or may serve as a conduit to allow various command signals inputted from the cradle to be transferred to the watch type mobile terminal therethrough. Various command signals or power inputted from the cradle may be operated as a signal for recognizing that the watch type mobile terminal is accurately mounted on the cradle.

The output unit 150 is configured to provide outputs in a visual, audible, and/or tactile manner (e.g., audio signal, video signal, alarm signal, vibration signal, etc.). The output unit 150 may include the display unit 151, an audio output module 152, an alarm unit 153, and the like.

The display unit 151 may display information processed in the watch type mobile terminal 100. For example, when the watch type mobile terminal 100 is in a phone call mode, the display unit 151 may display a User Interface (UI) or a Graphic User Interface (GUI) associated with a call or other communication (such as text messaging, multimedia file downloading, etc.). When the watch type mobile terminal 100 is in a video call mode or image capturing mode, the display unit 151 may display a captured image and/or received image, a UI or GUI that shows videos or images and functions related thereto, and the like.

Meanwhile, when the display unit 151 and the touch pad are overlaid in a layered manner to form a touch screen, the display unit 151 may function as both an input device and an output device. The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like.

The proximity sensor 141 may be disposed within or near the touch screen. The proximity sensor 141 is a sensor for detecting the presence or absence of an object relative to a certain detection surface or an object that exists nearby by using the force of electromagnetism or infrared rays without a physical contact. Without the proximity sensor 141, if the touch screen is an electrostatic type, the approach of a pointer (stylus) can be detected based on a change in a field according to the approach of the pointer.

The audio output module 152 may convert and output as sound audio data received from the wireless communication unit 110 or stored in the memory unit 160 in a call signal reception mode, a call mode, a record mode, a voice recognition mode, a broadcast reception mode, and the like. Also, the audio output module 152 may provide audible outputs related to a particular function performed by the watch type mobile terminal 100 (e.g., a call signal reception sound, a message reception sound, etc.). The audio output module 152 may include a speaker, a buzzer, or other sound generating device.

The alarm unit 153 (or other type of user notification means) may provide outputs to inform about the occurrence of an event of the watch type mobile terminal 100. Typical events may include call reception, message reception, key signal inputs, a touch input etc. In addition to audio or video outputs, the alarm unit 153 may provide outputs in a different manner to inform about the occurrence of an event. For example, the alarm unit 153 may provide an output in the form of vibrations (or other tactile or sensible outputs). When a call, a message, or some other incoming communication is received, the alarm unit 153 may provide tactile outputs (i.e., vibrations) to inform the user thereof. By providing such tactile outputs, the user can recognize the occurrence of various events even if his mobile phone is in the user's pocket. Outputs informing about the occurrence of an event may be also provided via the display unit 151 or the audio output module 152.

The memory unit 160 may store software programs or the like used for the processing and controlling operations performed by the controller 180, or may temporarily store data (e.g., a phonebook, messages, still images, video, etc.) that have been outputted or which are to be outputted. In addition, the memory unit 160 may store data regarding various patterns of vibrations and sounds outputted when a touch is applied onto the touch screen.

The memory unit 160 may include at least one type of storage medium including a Flash memory, a hard disk, a multimedia card, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only Memory (PROM), a magnetic memory, a magnetic disk, an optical disk, and the like. Also, the watch type mobile terminal 100 may cooperate with a network storage device that performs the storage function of the memory unit 160 over a network connection.

The controller 180 typically controls the general operations of the watch type mobile terminal. For example, the controller 180 performs controlling and processing associated with voice calls, data communications, video calls, and the like. In addition, the controller 180 may include a multimedia module 181 for reproducing (or playing back) multimedia data. The multimedia module 181 may be configured within the controller 180 or may be configured to be separate from the controller 180.

The controller 180 may perform a pattern recognition processing to recognize a handwriting input or a picture drawing input performed on the touch screen as characters or images.

The power supply unit 190 receives external power (via a power cable connection) or internal power (via a battery of the watch type mobile terminal) and supplies appropriate power required for operating respective elements and components under the control of the controller 180.

The watch type mobile terminal according to an exemplary embodiment of the present invention has been described in view of the components according to the function of the watch type mobile terminal. Hereinafter, the watch type mobile terminal will be described in the aspect of mechanical components.

Figure 2:
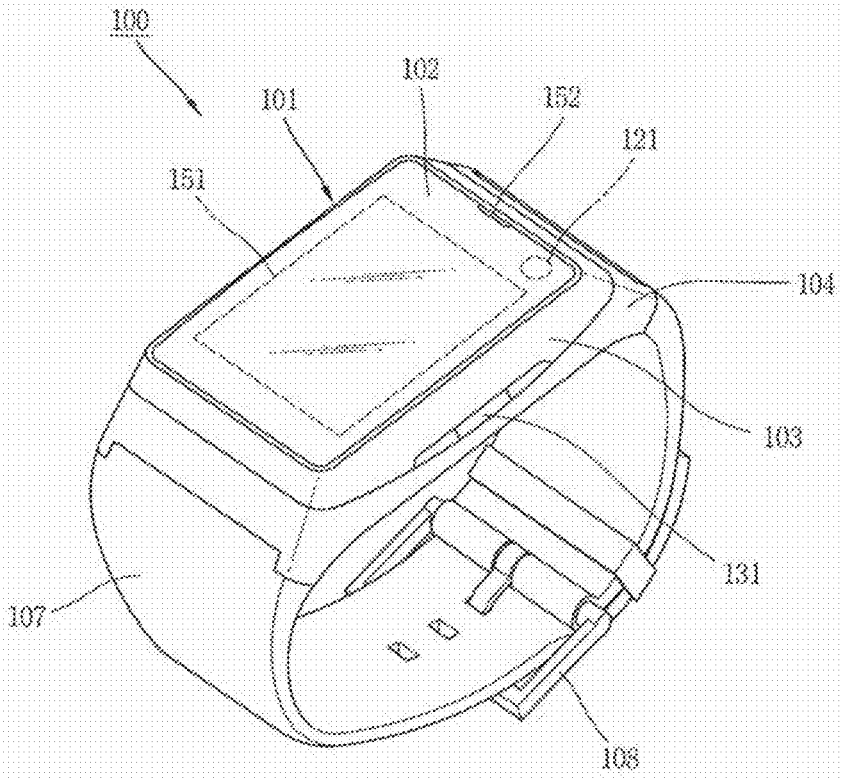
FIG. 2 is a top perspective view of the watch type mobile terminal according to an exemplary embodiment of the present invention.

FIG. 2 is a top perspective view of the watch type mobile terminal according to an exemplary embodiment of the present invention.

As shown in FIG. 2, the watch type mobile terminal 100 includes a terminal body 101 disposed such that the display unit 151 is exposed from an upper surface thereof, and both ends of the terminal body 101 are connected by a band 107 formed to allow the user to put the watch type mobile terminal 100 on his body such as the wrist arm, and so one. The terminal body 101 may include devices for various supplementary functions including a mobile communication module allowing for communication with a base station, a network, a server device, an external device, and the like, in a communication network.

The terminal body 101 includes a plurality of cases forming an external appearance. In FIG. 2, a first case 103 and a second case 104 are shown to be exposed.

A light-transmissive window 102 is installed on upper surface of the first case 103 such that the display unit 151 is seen therethrough. The audio output module 152 for outputting a sound and a camera device 121 for capturing an image are disposed at one side of the display unit 151 within the window 102.

The display unit 151 includes a liquid crystal display (LCD), an organic light emitting diode (OLED) module, an e-paper, and the like, which visually displays information. The display unit 151 may include a touch pad allowing for an input in a tactile manner. Accordingly, when a touch is applied to a portion on the window 102, content corresponding to the touched position is inputted. The content inputted in a tactile manner may be characters, numbers, a menu item that can be instructed or designated in various modes, and the like. A structure for increasing visibility of the display unit 151 at a bright area may be included at an upper portion of the display unit 151.

The audio output module 152 may be a receiver in the aspect that it outputs a reception sound, and may be formed as a loud speaker for providing a louder sound in outputting a notification sound of a system or in a speaker phone mode or a multimedia reproduction mode, and the like.

The camera device 121 may be configured to capture a still image or video of a subject and may be used for taken an image of the user himself during video call communication.

A side button 131 for a manipulation is disposed on the side of the terminal body 101. The side button 131 may be generally called a manipulation unit and receives a command for controlling the operation of the watch type mobile terminal. Various methods can be employed for the side button 131 so long as it can operate by the user in a tactile manner. Convent inputted by the side button 131 may be variably set. For example, commands such as turning on or off power, controlling the camera device 121, adjusting the size of a sound outputted from the audio output module 152, changing of the display unit 151 to a touch recognition mode, and the like, may be received through the side button 131.

The band 107 may be formed to be flexible so as to be easily put on the user's body. For example, the band 107 may be made of leather, rubber, plastic, and the like, and may be formed to have a multi-layered structure by stacking several unit layers.

A fastener 108 may be provided to the band 107. The fastener 108 may be implemented as a buckle, a snap-fit hook, or Velcro™, etc., and may have an elastic portion or may be made of an elastic material. The fastener 108 as shown in FIG. 2 is a buckle type fastener.

Figure 3:
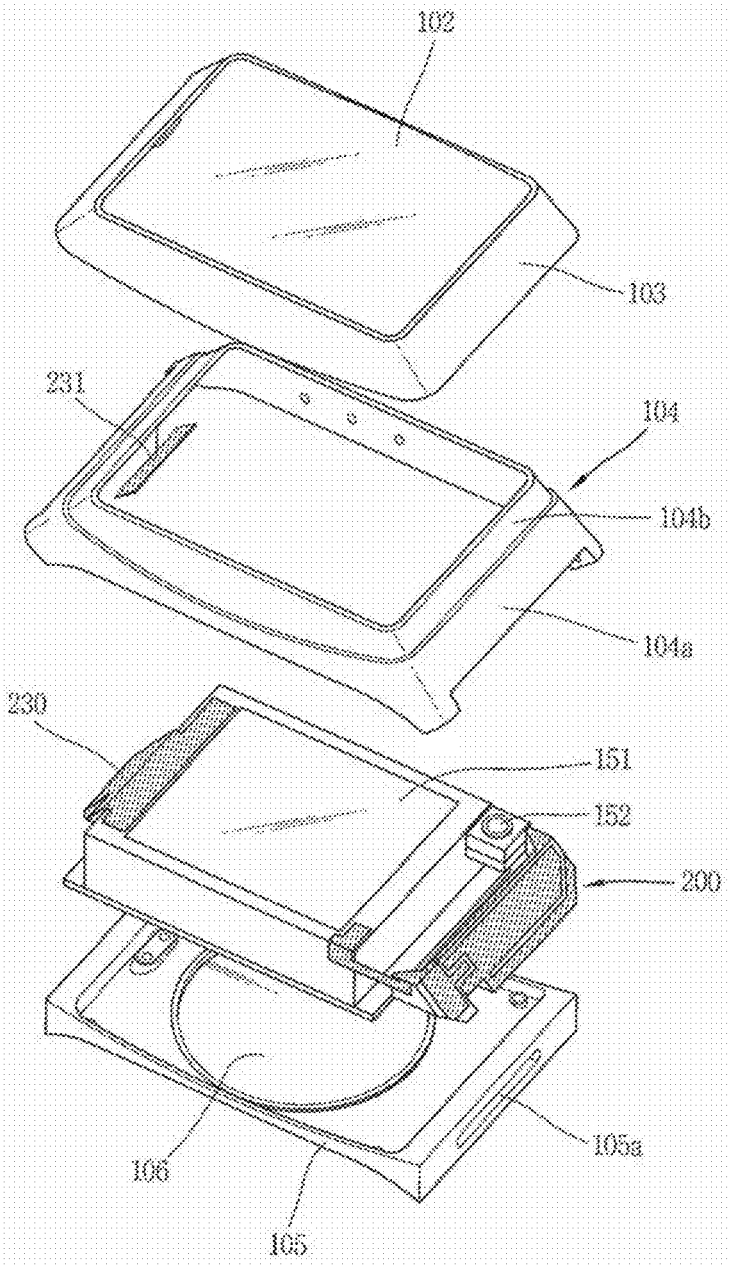
FIG. 3 is an exploded perspective view of the watch type mobile terminal of FIG. 2.

FIG. 3 is an exploded perspective view of the watch type mobile terminal of FIG. 2. As shown in FIG. 3, the cases constituting the external appearance of the terminal body 101 include a first case 103 forming a peripheral configuration of the window 102, and second and third cases 104 and 105 sequentially assembled to a lower portion of the first case 103.

The second case 104 includes an accommodation space part for mounting various components, and a mounting recess 104*b* is formed on an upper end of the second case 104 to allow the first case 103 to be insertedly mounted therein.

The first case 103 is a part that can be easily in contact with an external object of the watch type mobile terminal 100 along with the window 102, so it may be made of a metal material so as to minimize its abrasion or scratch. In addition, the first case 103 may be made of a conductive material in order to extend a ground of the antenna 200 (to be described). Also, the first case 103 may be implemented as an 'ornament' present on the surface of the 'case', as well as its role as a substantial 'case'.

The second case 104 is made of a dielectric material so as to smoothly induce radiation of the antenna 200. The second case 104 may be made of a resin or the like in order to facilitate formation of an intricate internal shape.

Externally, the second case 104 includes a slope side 104*a* forming a smooth side appearance of the window 102, and the antenna 200 is disposed on an inner surface of the slope side 104*a*. Thus, the antenna 200 is positioned such that it does not overlap with the first case 103 and disposed at a slope angle, maintaining a certain distance from the third case 105, so the radiation of radio frequency energy of the antenna 200 can be less restricted.

The third case 105 assembled to the lower portion of the second case 104 is formed to be conductive to form a main ground of the antenna 200. The third case 105 may include a cover 106 detachable to allow a SIM card or the like to be inserted therein.

Figure 4:
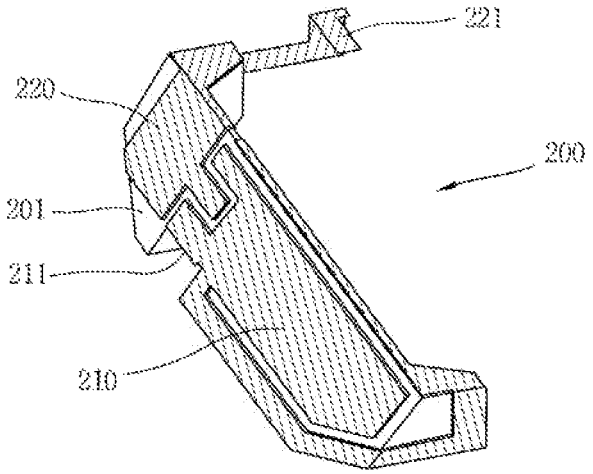
FIG. 4 is a perspective view of an antenna according to an exemplary embodiment of the present invention.

FIG. 4 is a perspective view of an antenna according to an exemplary embodiment of the present invention. As shown in FIG. 4, the antenna 200 is illustrated to have a plate shape attached to a dielectric carrier 201. The carrier 201 is formed to be parallel to the inner side of the slope side 104*a* so as to be easily disposed on the inner surface of the slope side 104*a*.

The antenna 200 includes a first conductor 210 formed to be connected with a signal feeding part 211 and a second conductor 220 disposed to be separated from the first conductor 210 such that it can be electrically coupled with the first conductor 210.

The first conductor 210 has a certain pattern to have a length suitable for a resonance frequency band. The first conductor 210 is connected to the signal feeding part 211, and the signal feeding part 211 is formed to be brought into contact with a contact member 262 (See FIG. 8) formed on a circuit board. The contact member 262 may be formed as an elastic spring having a channel-like shape and can be attached to the circuit board through welding. Conversely, the signal feeding part 211 itself may be formed as an elastic spring type.

The second conductor 220 is formed such that it can be electrically coupled with the first conductor 210 in order to extend a high bandwidth. The second conductor 220 is connected with a ground feeding part 221 so as to be connected to a ground of the watch type mobile terminal 100. In detail, the ground feeding part 221 is connected with a ground (not shown) of the display unit 151, and the ground of the display unit 151 is sequentially connected with a conductive layer 192 covering the battery 190 and a shield can 265 surrounding the circuit board 260.

The first conductor 210 may be formed to be resonated at a multi-band including GSM800~900, DCS1600~1800, PCS1600~1900, W2100, and the like. The second conductor 220 serves to generate coupling at a high band to extend the bandwidth of the high band.

For example, as shown in FIG. 4, the first conductor 210 includes a first end portion 212 formed to be convex and separated from the first end portion 212 with a certain gap therebetween. The electrical coupling structure can effectively solves a problem of insufficient space for installing the antenna required for satisfying all the bands as mentioned above when the antenna is installed at the inner side of the watch type mobile terminal.

Figure 5:
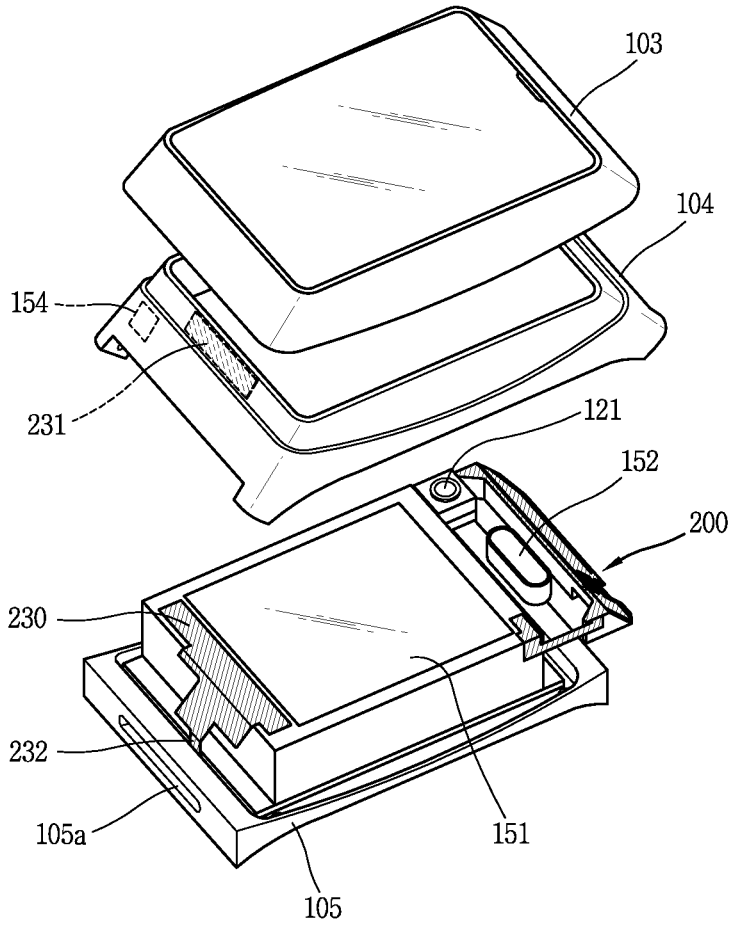
FIG. 5 is an exploded perspective view of the watch type mobile terminal viewed in a different direction.

FIG. 5 is an exploded perspective view of the watch type mobile terminal of FIG. 2 viewed in a different direction.

As shown in FIG. 5, the watch type mobile terminal 100 illustrated in FIG. 5 includes a first ground extending part 230 for extending a ground of the antenna 200 to the first case 103.

The first ground extending part 230 includes a conductive layer 231 disposed to be parallel to the first case 103 at an inner side of the second case 104. Thus, as an electrical coupling is generated between the first case 103 and the conductive layer 231, a ground length of the antenna 200 can be lengthened. The conductive layer 231 may be formed in the form of a conductive gasket or a tape.

Figure 6:
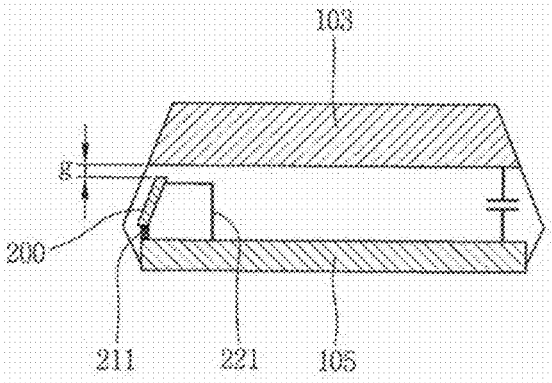
FIG. 6 is a conceptual sectional view of a terminal main body according to an exemplary embodiment of the present invention.

This principle will now be described with reference to FIGS. 6 and 7. FIG. 6 is a conceptual sectional view of a terminal main body according to an exemplary embodiment of the present invention, and FIG. 7 is a conceptual view for explaining the principle of increasing the length of a ground.

As shown in FIG. 6, a ground feeding part 221 connected with the antenna 200 is connected with the third case 105 forming a ground, and the antenna 200 may be disposed to be coupled with the first case 103 with a certain gap (e.g., 0.5 mm as the thickness of the second case) therebetween. The first case 103 is coupled with the third case 105 at the opposite side of the antenna 200.

Figure 7A:
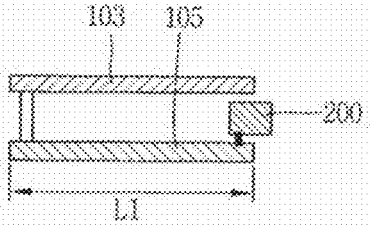
FIG. 7 is a conceptual view for explaining the principle of increasing the length of a ground.
Figure 7B:
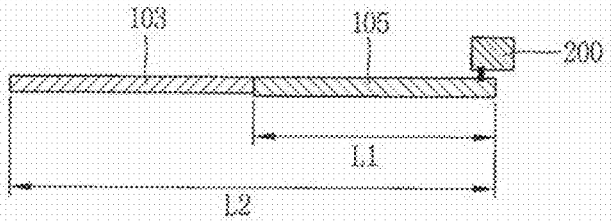

As a result, the ground length is limited to a length L1 of the third case 105 in the section form as shown in FIG. 7A, but as shown in FIG. 7B, because of the electrical coupling between the first case 103 and the third case 105, an effect that a ground length L2 is equivalent to the sum of the length of the third case 105 an the length of the first case 103 can be obtained. Thus, radio performance of the antenna 200 can be improved and is less affected by a human body (also called a 'hand effect').

The conductive layer 231 and the first ground extending part 230 are disposed at the opposite side of the slope side 104*a* of the second case 104 where the antenna 200 is disposed. In particular, because a controller 105 of the touch pad is disposed in the space where the conductive layer 231 is disposed, mutual influence between the touch pad and the antenna 200 can be reduced.

The first ground extending part 230 is directly connected to the third case 105 by a flexible printed circuit board (FPCB) 232 in order to maximize the ground extension effect.

Figure 8:
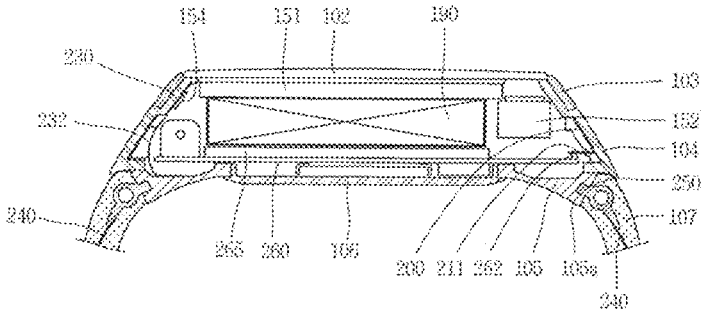
FIG. 8 is a sectional view showing a detailed configuration of the watch type mobile terminal according to an exemplary embodiment of the present invention.

FIG. 8 is a sectional view showing a detailed configuration of the watch type mobile terminal according to an exemplary embodiment of the present invention. As shown in FIG. 8, the watch type mobile terminal 100 includes components assembly mounted in an accommodation space formed by the second case 104 and the third case 105. The components assembly includes a circuit board 260, a battery 190, a display unit 151, and an audio output unit 152.

A socket 261 is formed on a lower surface of the circuit board 260 to mount an SIM card thereon, and a component such as a processor for radio communication, a processor for driving multimedia, or the like, is mounted on an upper surface of the circuit board 260. The upper surface of the circuit board 260 is covered by the shield can 265, interrupting an electromagnetic interference.

The battery 190 disposed at an upper side of the circuit board 260 is formed such that it can be recharged. The battery 190 receives power from an external source through a terminal exposed from the lower surface of the third case 105 so as to be charged.

Figure 9:
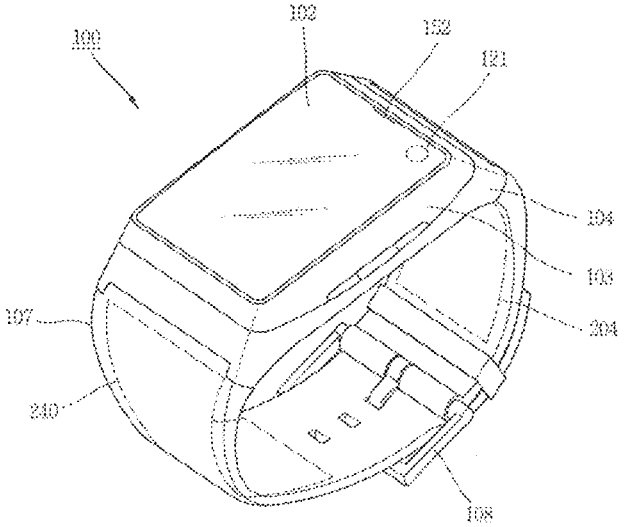
FIG. 9 is a perspective view of the watch type mobile terminal including a second ground extending part mounted on a band.

FIG. 9 is a perspective view of the watch type mobile terminal including a second ground extending part mounted on a band. As shown in FIG. 9, the ground limited to the third case 105 can be extended by the second ground extending part 240 inserted to be parallel in the band 107.

Figure 10:
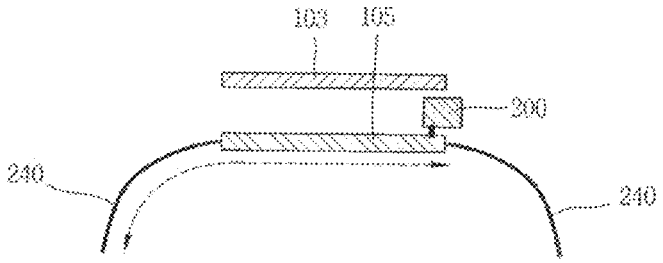
FIG. 10 is a conceptual view showing the principle of the second ground extending part illustrated in FIG. 9.

FIG. 10 is a conceptual view showing the principle of the second ground extending part illustrated in FIG. 9.

As shown in FIG. 10, it is noted that the length of the ground of the third case 105 extends by the second ground extending part 240 included in the band 107. A ¼λ condition with respect to a low band such as GSM800~900 can be easily satisfied by the band 107, and because the second ground extending part 240 added to the band 107 is not exposed, an aesthetic appearance cannot be hampered.

Figure 11:
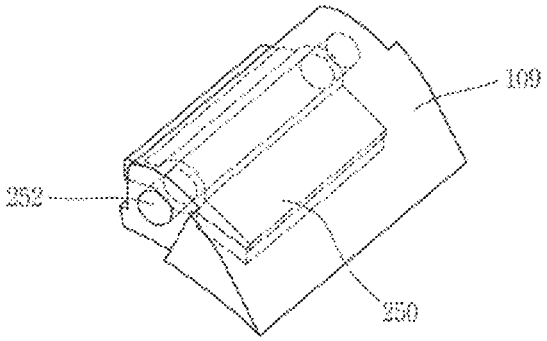
FIG. 11 is a perspective view showing a connection structure of the band for connecting the second ground extending part according to an exemplary embodiment of the present invention.
Figure 12:
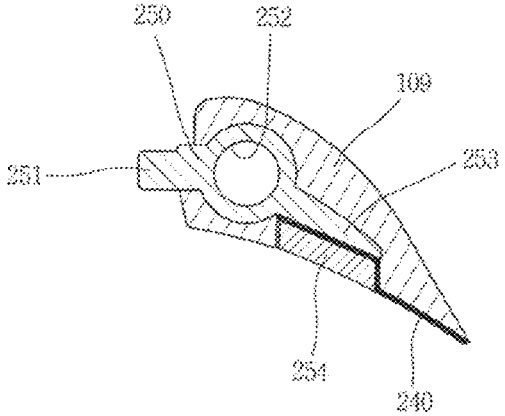
FIG. 12 is a sectional view showing a connection structure of the band of FIG. 11.

FIG. 11 is a perspective view showing a connection structure of the band for connecting the second ground extending part according to an exemplary embodiment of the present invention, and FIG. 12 is a sectional view showing a connection structure of the band of FIG. 11.

As shown in FIGS. 11 and 12, a support member 109 having a pin hole 252 for supporting a pin and a metal connection member 254 disposed at an inner side of the support member 109 are provided at an end portion of the band 107.

The support member 109 is made of rubber or a plastic material in order to strengthen an adhesive force of the band made of leather or plastic, and the connection member 254 is installed at the inner side of the support member 109 in order to connect the ground of the terminal body 101 to the second ground extending part 240.

In order to prevent a contact force of the connection member 254 from weakening when the band 107 is put on, the connection member 254 includes a protrusion 251 which is brought into contact with the third case 105 when the band 107 is assembled. Also, a receiving recess 105*a* for receiving the protrusion 251 is formed at an end portion of the third case 105. Thus, when the band 107 is fixed to the second case 104 by a pin, the protrusion of the connection member 254 disposed at the end of the band 107 is received by the accommodation recess 105*a* of the third case 105 so as to be electrically connected constantly.

The second ground extending part 240 may be made of a flexible conductive material. Preferably, the second ground extending part 240 may be formed in the form of a conductive tape. FIG. 12 shows that the second ground extending part 240 is attached to the connection member 254 by a fixing mold 254 inserted into the support member 109 to thereby guarantee an adhesive force with respect to the connection member 250 of the second ground extending part 240.

As described above, the watch type mobile terminal according to exemplary embodiments of the present invention have the following advantages.

That is, because the cases having a metal component are positively used to extend the ground, radio performance of the antenna can be improved.

The ground of the antenna installed at the inner side of the nonmetal second case extends to the first case, so the first case can become a secondary antenna. The first case can be used as an element for forming an external ornament of the watch type mobile terminal, requirements in a design view or in view of the antenna performance can be easily satisfied.

As the exemplary embodiments may be implemented in several forms without departing from the characteristics thereof, it should also be understood that the above-described embodiments are not limited by any of the details of the foregoing description, unless otherwise specified, but rather should be construed broadly within its scope as defined in the appended claims. Therefore, various changes and modifications that fall within the scope of the claims, or equivalents of such scope are therefore intended to be embraced by the appended claims.

What is claimed is:

1. A watch type mobile terminal comprising:

a case whose both ends are connected by a band, the case comprising:

a first conductive case forming a surrounding configuration of a window;

a second dielectric case assembled to a lower portion of the first conductive case and having an accommodation space part for accommodating a plurality of components therein, wherein the second dielectric case is sized such that at least an entire perimeter of an upper portion of the second dielectric case is enclosed by the first conductive case; and a third conductive case assembled to a lower portion of the second dielectric case, the third conductive case forming a main ground;

the first, second, and third cases constitute an external appearance of the watch type mobile terminal;

an antenna disposed on an inner surface of a sloped side of the second dielectric case; and a first ground extending part disposed on a side of the second dielectric case opposite the sloped side, wherein:

the antenna is positioned to be spaced from the first conductive case by a predetermined gap such that the antenna is electrically coupled with the first conductive case;

the antenna comprises:

a first conductor configured to be connected to a signal feeding portion; and a second conductor positioned to be separated from the first conductor such that the second conductor is electrically coupled with the first conductor and configured to be connected to a ground feeding unit to be connected to the main ground;

the first conductive case, which is made of a conductive material, is electrically coupled with the antenna; and the first ground extending part comprises a conductive layer disposed on an inner side of the second dielectric case and positioned to be adjacent to the first case at a certain interval such that an electrical coupling is generated between the first conductive case and the conductive layer, thereby electrically coupling the main ground of the third case to the first conductive case and improving radio performance.

2. The watch type mobile terminal of claim 1, wherein the ground feeding unit is configured to be connected with a ground of a display accommodated in the accommodation space part.

3. The watch type mobile terminal of claim 1, wherein the inner surface of the second dielectric case is formed as a sloped side such that a perimeter of a top portion of the second dielectric case is smaller than a perimeter of a bottom portion of the second dielectric case, and the antenna is positioned underneath the inner surface of the sloped side such that the antenna is tilted at a same angle as the slope of the inner surface of the second dielectric case.

4. The watch type mobile terminal of claim 1, wherein the antenna is formed to have a plate form attached to a dielectric carrier.

5. The watch type mobile terminal of claim 4, wherein:

the first conductor comprises a first end portion formed to be convex;

the second conductor comprises a second end portion positioned to be separated from the first end portion and formed to be concave; and the first end portion and the second end portion are separated by a gap such that the first end portion and the second end portion are not in direct contact with each other.

6. The watch type mobile terminal of claim 1, wherein the first ground extending part is positioned on an opposite side of the inner side portion of the second dielectric case where the antenna is positioned.

7. The watch type mobile terminal of claim 6, further comprising:

a touch pad formed underneath the window to detect a touch input received via the window; and a controller of the touch pad positioned to be adjacent to the inner side portion of the second dielectric case where the first ground extending part is positioned.

8. The watch type mobile terminal of claim 1, wherein the first ground extending part is directly connected to the third conductive case by a flexible printed circuit board (FPCB).

9. The watch type mobile terminal of claim 8, wherein the first ground extending part is configured to be additionally connected to a ground of a display accommodated in the accommodation space part.

10. The watch type mobile terminal of claim 1, further comprising:

a second ground extending part extending the main ground to the band.

11. The watch type mobile terminal of claim 10, wherein the second ground extending part is implemented in the form of a flexible conductive tape mounted to the band.

12. The watch type mobile terminal of claim 11, wherein the band comprises:

a support member supporting a pin; and a connection member positioned at an inner side of the support member and connected to the second ground extending part.

13. The watch type mobile terminal of claim 12, wherein the connection member comprises a protrusion configured to be in contact with the third conductive case, and the third conductive case comprises an accommodation recess accommodating the protrusion therein.

14. A watch type mobile terminal comprising: a case whose both ends are connected by a band and having a main ground;

a frame mounted over the case such that at least an entire perimeter of an upper portion of the case is enclosed by the frame;

the case and frame constitute an external appearance of the watch type mobile terminal;

an antenna disposed on an inner surface of a sloped side of the case and a first ground extending part disposed on a side of the case opposite the sloped side, wherein the antenna comprises: a first conductor configured to be connected to a signal feeding portion; and a second conductor positioned to be separated from the first conductor such that the second conductor is electrically coupled with the first conductor and configured to be connected to a ground feeding unit to be connected to a main ground, wherein the antenna is positioned to be spaced from the frame by a predetermined gap such that at least the first conductor or the second conductor is electrically coupled with the frame, wherein the frame, which is made of a conductive material, is electrically coupled with the at least the first conductor or the second conductor, and wherein the first ground extending part comprises a conductive layer disposed on an inner side of the case and positioned to be adjacent to the frame at a certain interval such that an electrical coupling is generated between the frame and the conductive layer, thereby electrically coupling the main ground of the case to the frame and improving radio performance.

15. The mobile terminal of claim 14, further comprising:

a camera configured to capture a still image or a video of a subject;

a communication module configured to: communicate with other device in a communication network; and transmit the captured still image or video during video call communication; and a display having a display screen which is visible through a window mounted to the frame, wherein the display screen and a lens of the camera face a same direction toward the subject.

16. The mobile terminal of claim 14, further comprising:

a display having a display screen which is visible through a window mounted to the frame; and an input unit, wherein:

the display includes a touch pad such that a touch input is recognizable when a portion of the window is touched;

the display is configured to be in a touch recognition mode in response to an input received via the input unit; and the touch input is recognized only when the display is set to the touch recognition mode.

17. The watch type mobile terminal of claim 1, further comprising a display, wherein:

the second dielectric case is shaped to form an opening through which a display screen of the display is exposed toward the window; and a size of the opening is same as a size of the window such that all information displayed on the display screen is visible via the window.

18. The watch type mobile terminal of claim 17, wherein:

the first ground extending part is positioned at or near a first side of the display and the antenna is positioned at or near a second side of the display; and the second side of the display is an opposite side of the first side of the display such that the display is positioned between the first side and the second side.

* * * * *